United States Patent [19]

Gerwig

[11] Patent Number: 4,467,544

[45] Date of Patent: Aug. 28, 1984

[54] HYPODERMIC DART GUN

[76] Inventor: Phillip L. Gerwig, 2222 Nankin Rd., Ashland, Ohio 44805

[21] Appl. No.: 430,807

[22] Filed: Sep. 30, 1982

[51] Int. Cl.[3] ..... F41C 27/00

[52] U.S. Cl. ..... 42/1 R; 42/8; 42/27

[58] Field of Search ..... 42/1 R, 1 F, 1 M, 1 Z, 42/8, 26, 27, 32, 40

[56] References Cited

U.S. PATENT DOCUMENTS

| | | | |
|---|---|---|---|
| 3,346,981 | 10/1967 | Tabor | 42/1 R |
| 3,381,403 | 5/1968 | Murdoch | 42/1 R |
| 3,745,682 | 7/1973 | Waldeisen | 42/1 R |

FOREIGN PATENT DOCUMENTS

| | | | |
|---|---|---|---|
| 624059 | 8/1961 | Italy | 42/1 R |
| 1547562 | 6/1979 | United Kingdom | 42/1 R |

*Primary Examiner*—Charles T. Jordan

*Attorney, Agent, or Firm*—Pearne, Gordon, Sessions, McCoy, Granger & Tilberry

[57] ABSTRACT

A hypodermic dart gun of the firearm type includes a user-adjustable valve for regulating the feed rate of high pressure combustion gases from an exploded blank cartridge into the breech end of a gun barrel containing a hypodermic dart whereby the velocity of the ejected dart, and hence its effective range, is controlled. A pivotally mounted breech block for receiving the blank cartridge includes a baffle element for generating high combustion gas temperatures and pressures to ensure complete burning of the smokeless type gunpowder used in conventional blank cartridges. The adjustable valve forms a part of the breech block and is comprised of a high-temperature-resistant metering orifice whose cross-sectional area is determined by the position of a threaded member turnable in screwlike fashion into and out of a bore in a wall of the breech block.

8 Claims, 7 Drawing Figures

FIG. 1
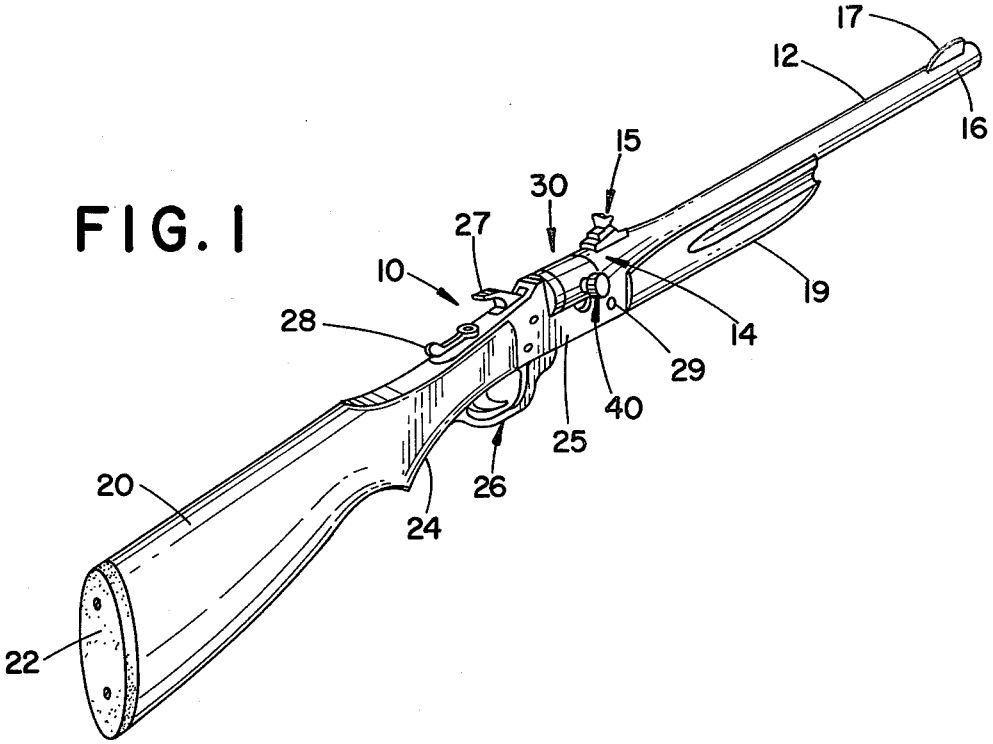
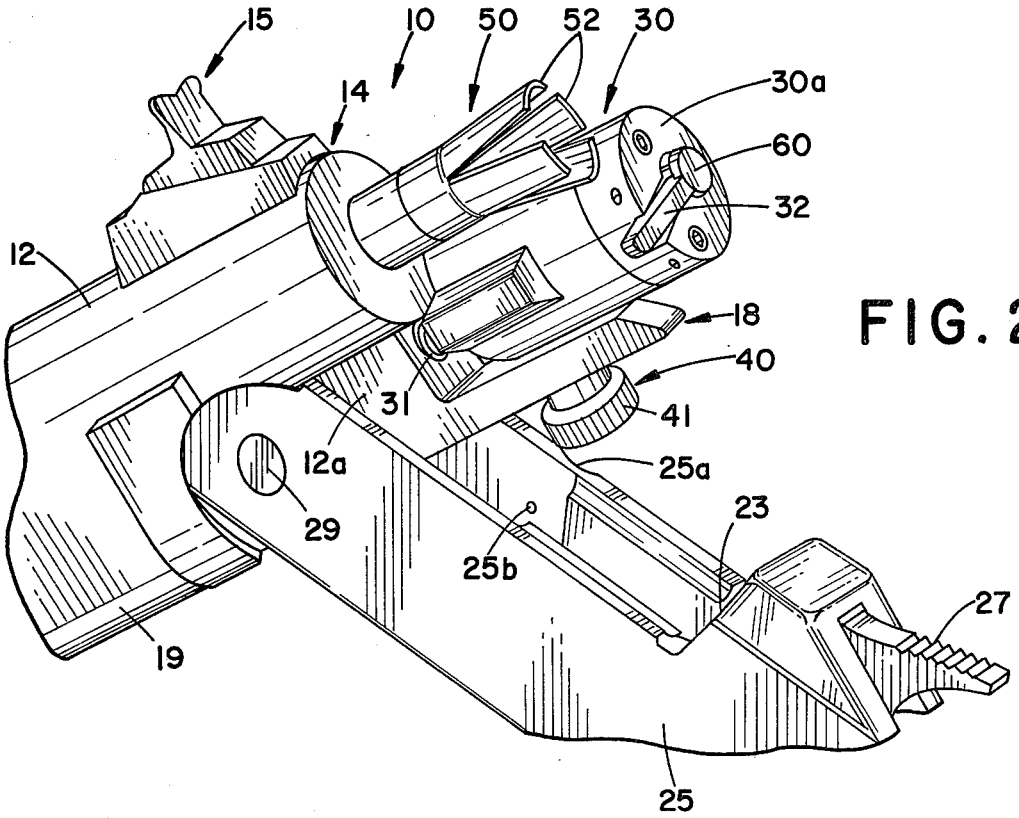
FIG. 2

HYPODERMIC DART GUN

BACKGROUND OF THE INVENTION

The present invention relates in general to firearms, and more particularly to a hypodermic dart gun for use in anesthetizing wild animals undergoing zoological study and the like.

U.S. Pat. No. 3,381,403 to Murdock discloses a hypodermic dart gun of the firearm type wherein combustion gases generated by an exploding blank cartridge are fed into the breech end of a gun barrel to forcibly eject a hypodermic dart contained therein. In one embodiment, Murdock varies the volume of a relatively large combustion gas expansion chamber to regulate the ejection velocity of the dart, and hence its range. In another Murdock embodiment, combustion gases from a relatively large fixed volume expansion chamber are fed into the breech end of the gun barrel via an adjustable valve regulating the feed rate of the combustion gases, and hence determining the velocity and effective range of the ejected dart.

While the Murdock gun may provide adequate regulation of dart velocity and range, it is of complex design, requiring the generated combustion gases from an exploded blank cartridge to follow a sinuous route before finally being injected into the breech end of the barrel. Such sinuous routing of the combustion gases through one or more relatively large volume gas expansion chambers may result in incomplete burning of the blank cartridge gunpowder, wherein the ejection velocity of the dart could be deleteriously affected. Also, the incompletely burned gunpowder residue could clog the combustion gas pathway after only a few firings of the gun. The complexity of the Murdock gun makes it very difficult to clean. Further, manipulation of a movable gun barrel is required to load a dart into the one version of Murdock's gun, while removal of a barrel end cap is required to load another Murdock version of his gun. Such dart loading techniques are considered undesirable from both a complexity and time-consuming standpoint.

In view of the foregoing disadvantages of the prior art Murdock device, it would be desirable to provide a firearm type dart gun of simpler design having means for adjusting the ejection velocity of the associated hypodermic dart. Such a simplified design should ensure complete burning of conventional blank cartridge gunpowder, and should also permit rapid loading of the hypodermic dart without excessive manipulation or partial disassembly of the gun.

SUMMARY OF THE INVENTION

In accordance with the present invention, a hypodermic dart gun of the firearm type includes an elongated barrel member having a breech end and a muzzle end, the breech end of the barrel being adapted to receive and frictionally engage a hypodermic dart. A pivotally mounted breech block member is movable between a firing position, at which the breech block member engages and generally closes the breech end of the barrel, and a loading position, at which the breech block member disengages from the breech end to permit insertion of the hypodermic dart into the breech end of the barrel.

Preferably, the movable breech block member has at least two serially connected chambers for directing combustion gases from an exploded blank cartridge into the breech end of the barrel to forcibly eject the dart out of the muzzle end thereof. The two chambers are in fluid communication with each other solely via baffle means restricting the flow of combustion gases from one chamber to the other to establish high combustion gas pressures and temperatures immediately subsequent to the exploding of a blank cartridge into one of the chambers. The other combustion chamber supplies the combustion gases directly to the breech end of the barrel to forcibly eject the dart out the muzzle end thereof. The high temperature and pressure combustion gases generated in accordance with the invention ensure substantially complete burning of the gunpowder generating the combustion gases.

Preferably, an adjustable valve having a high-temperature-resistant metering orifice is used to govern the feed rate of the combustion gases into the breech end of the barrel, thereby determining the velocity and effective range of the ejected dart.

BRIEF DESCRIPTION OF THE DRAWINGS

A fuller understanding of the invention may be had by referring to the following description and claims taken in conjunction with the accompanying drawings, wherein:

FIG. 1 is a perspective view of a hypodermic dart gun in accordance with the present invention, the dart gun being in a firing condition;

FIG. 2 is a perspective view of the dart gun of FIG. 1, with end portions cut away, the dart gun being broken open into a loading condition;

DETAILED DESCRIPTION OF THE PREFERRED EMBODIMENT

Figure 3:
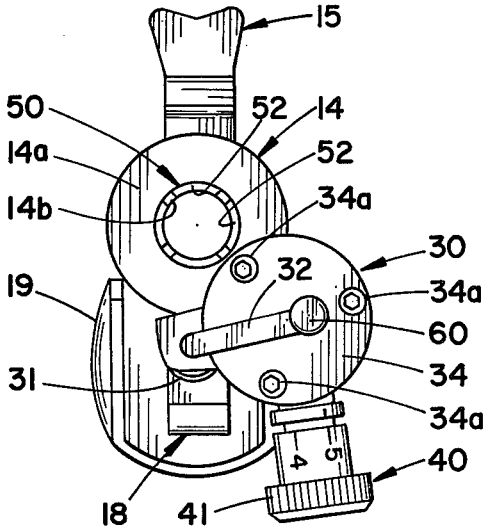
FIG. 3 is an end view of a movable breech block member at its loading position in association with the breech end of the gun barrel illustrated most clearly in FIG. 2.

FIG. 1 illustrates a hypodermic dart gun 10 of the firearm type, the gun 10 being of rifle or shotgun configuration and being illustrated in a firing condition.

The gun 10 includes an elongated, rifled bore, barrel member 12 having a breech end 14 and a muzzle end 16, the calibre of the barrel member 12 being suitable for projecting a conventional hypodermic dart. A conventional adjustable rear sight 15, of the open type, is fixed on the upper surface portion of the breech end 14 of the barrel member 12. A front sight blade 17 fixed to the upper surface portion of the muzzle end 16 of the barrel member 12 cooperates with the rear sight to constitute conventional aiming means for the dart gun 10.

Underlying a major portion of the barrel member 12 is a conventional, fore-end 19 which is fixed in position relative to the barrel member 12 and is gripped by one hand of the user in a conventional manner when aiming and firing the gun 10 from the user's shoulder.

A stock 20 has a conventional butt plate 22 and a typical grip portion 24 which are to the rear (or left as viewed in FIG. 1) of a suitable receiver 25 having a conventional firing mechanism (not shown) actuated by a trigger 26 controlling a hammer 27 via the firing mechanism.

The barrel member 12 and the fore-end 19 are fixed in position relative to each other, while the stock 20 and receiver 25 are fixed in position relative to each other. The stock 20 and receiver 25 as a unit are pivotally joined to the barrel member 12, with its associated fore-end 19, by a hinge pin 29 constituting a conventional pin joint. A conventional latch lever 28 carried on top of the receiver 25 serves to releasably lock the barrel member 12 in a firing position relative to the stock 20 and receiver 25, as illustrated in FIG. 1.

In accordance with the present invention, the hypodermic dart gun 10 of FIG. 1 includes a pivotally mounted, cylindrically shaped, multi-chambered breech block member 30 positioned between the hammer 27 and the breech end 14 of the barrel member 12. As will be subsequently illustrated in greater detail, the breech block member 30 is loaded with a conventional blank cartridge that is exploded by the hammer 27 to inject high pressure combustion gases into the breech end 14 to force out of the muzzle end 16 of the barrel member 12 a hypodermic dart that has been positioned in the breech end 14. Knob-actuated adjustable valve means 40, carried on the breech block member 30, determines the feed rate of combustion gases generated within the breech block 30 into the muzzle end 14 of the barrel member 12 to control the velocity, and hence the effective range of the hypodermic dart.

A further understanding of the operation of the pivotally mounted breech block member 30 can be had with reference to FIG. 2, which illustrates the hypodermic dart gun 10 of FIG. 1 in a broken open condition, wherein the receiver 25 has pivotally moved relative to the barrel member 12 about a rotation axis provided by the hinge pin 29. Thus, the hypodermic dart gun 10 as illustrated in FIG. 2 is in a loading condition as opposed to the firing condition of the gun 10 illustrated in FIG. 1. It can further be seen in FIG. 1 that the cylindrical breech block member 30 is in a coaxially aligned position with the longitudinal axis of the barrel member 12 when the gun 10 is in its firing position. When the gun 10 is broken open to its loading position as illustrated in FIG. 2, the breech block 30 pivotally moves out of coaxial alignment with the breech end 14 of the barrel member 12 to permit loading of a conventional hypodermic dart 50 having a plurality of resilient, featherlike plastic tail members 52 that frictionally engage the inner wall or bore of the barrel member 12. The barrel member 12 is preferably rifled so that a stabilizing spin action is imparted to the dart 50 as it is ejected from the muzzle end 16 of the barrel member 12. Pivotal movement of the breech block member 30 to its loading position as illustrated in FIG. 2 is provided by the torsional biasing force of a coil spring member 31 that, upon opening of the gun 10, causes the breech block member 30 to rotate about an axis parallel to the longitudinal axis of the barrel 12.

The pivotally mounted breech block member 30, as shown in FIG. 2, includes a leverlike ejector 32 that can engage the rim of a standard 22 caliber rim-fire blank cartridge 60 that is inserted into the rear portion of the breech block member 30, as will subsequently be illustrated in greater detail.

With the gun 10 in the open condition as illustrated in FIG. 2, rotation of the breech block 30, under the force of the biasing spring 31, is limited by its engagement with a conventional lock bolt 18 that cooperates with a locking mechanism carried in the receiver 25, the locking mechanism (not shown) being controlled by the latch lever 28 illustrated and discussed with regard to FIG. 1. With the dart 50 fully inserted into the breech end 14 of the barrel member 12, the receiver 25 and the barrel 12 can be pivoted back to their aligned firing position, as illustrated in FIG. 1. As such closing of the gun 10 occurs, a knob portion 41 of the adjustable valve means 40 will engage a cutaway portion **25*a* of the receiver 25, which will apply a force against the biasing spring 31, thus rotating the breech block member 30 in a counterclockwise manner towards its firing position, as illustrated in FIG. 1, i.e., in coaxial alignment with the barrel member 12. Just prior to the breech block member 30 reaching its firing position, as illustrated in FIG. 2, a receiver-mounted, breech block positioning stop pin 25*b* of predetermined length will engage the underside of the breech block member 30 to precisely position the breech block member 30 in coaxial alignment with the barrel 12. Engagement of the breech block member 30 with the breech block stop pin 25*b* provides spacing between the knob portion 41 of the valve 40 and grooved portion 25*a* of the receiver 25 to permit free turning of the knob portion 41**.

As the gun 10 is closed from its loading position in FIG. 2 to its firing position in FIG. 1, the ejector 32, which is spring-biased at its ejection position as illustrated in FIG. 2, will engage a back plate portion 23 of the receiver 25, wherein the ejector 32 engaging the rim of the blank cartridge 60 will pivot inwardly towards the rear face **30*a* of the breech block member 30. The ejector 32 and the end of the cartridge 60 establish a generally flush condition with the face 30*a* wherein the firing pin portion (not shown) carried on the striking forward end of the hammer 27 can fire the blank cartridge 60 upon actuation of the firing mechanism by the trigger 26 (see FIG. 1). When the blank cartridge 60 is fired, combustion gases generated by the exploding gunpowder of the cartridge are injected, via the breech block member 30, into the breech end 14 of the barrel member 12 rearwardly of the dart 50 to forcibly eject it out the muzzle end 16 of the gun barrel member 12. After the dart has been fired, the gun 10 is opened to its loading position illustrated in FIG. 2. Upon such opening, the ejector 32 springs or snaps from its flush condition with the back face 30*a* of the breech block member 30 to forcibly eject the spent blank cartridge 60 out of its position in the breech block member 30**.

With reference to FIG. 3, the breech block member 30 is shown at its loading position, the dart 50, having its featherlike tail members 52 fully inserted into the breech end 14 of the barrel member 12, the breech end 14 having a sealing face **14*a* that engages in fluidtight relation with a forward face of the breech block member 30 in a manner to be subsequently detailed. It can further be seen that the featherlike tail members 52, which are resilient in nature and normally extend outwardly to a slight degree from the dart axis as viewed in FIG. 2, are forced inwardly to frictionally engage a bore wall 14*b* of the breech end 14 of the barrel member 12, such frictional engagement ensuring that the dart 50 is spun by the rifled barrel member 12** as it is ejected.

Figure 4:
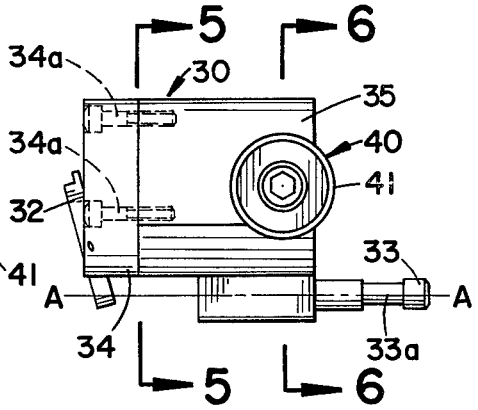
FIG. 4 is a side elevation view of the breech block member disassembled from the dart gun of FIG. 1.

With reference to FIG. 4, the breech block member 30 includes a cylindrical main body portion 35 which supports the adjustable valve means 40. Extending from the lower surface of the main body portion 35 is a pivot pin 33 having a longitudinal axis A—A about which the breech block member 30 rotates in a pivotal manner, the axis A—A constituting the axis of rotation of the breech block member 30 as noted earlier, the axis A—A being parallel to the longitudinal axis of the barrel member 12. The coil biasing spring 31 (see FIG. 2), which functions as a torsion type spring is helically wound and fits over the pivot pin 33, which is then received in a suitable bore in a breech block support portion 12*a* underlying the breech end 14 of the barrel member 12. One or more set-type screws (not shown) extending into the breech block portion 12*a* abut a reduced diameter section 33*a* of the pivot pin 33 to limit the axial movement (leftward and rightward as viewed in FIG. 4) of the breech block member 30 to a range of distance generally equal to the axial length of the reduced diameter section 33*a*. An axial biasing spring (not shown) located in the pivot pin receiving bore in the support portion 12*a* biases the breech block member 30 so that it axially moves a slight distance away from the sealing face 14*a* (see FIG. 3) when the gun 10 is moved to its open condition as illustrated in FIG. 2. Thus, upon opening of the gun 10 to its position illustrated in FIG. 2, the breech block member 30, under the force of biasing springs, will move slightly away from the sealing face 14*a* as it pivots out of alignment with the barrel member 12 to permit loading of the dart 50.

With further reference to FIG. 4, a plug end or rearward end 34 of the breech block member 30 is fastened to the main body portion 35 by a plurality of recessed cap screws 34*a* (see also FIG. 3).

Figure 5:
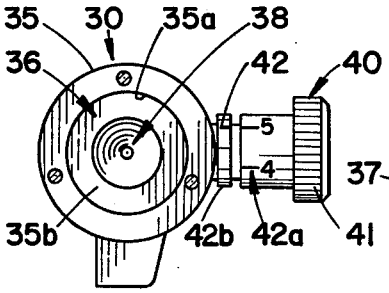
FIGS. 5 and 6 are cross section views taken along lines 5—5 and 6—6, respectively, of FIG. 4.

With reference to FIG. 5, the main portion 35 of the breech block member 30 can be seen to include a combustion gas swirl chamber of cylindrical shape defined by a circular wall 35*a*, the chamber 36 having one end closed by an end wall 35*b* having at its center a high-temperature-resistant metering orifice 38 that provides high pressure combustion gases from the chamber 36 directly into the barrel of the gun 10 at its breech end 14 to forcibly eject the hypodermic dart contained therein. The diameter of the metering orifice 38 is controlled by rotation of the knob portion 41 of the valve means 40, the knob portion 41 carrying on it range indicia 42*a* that are aligned relative to a fixed reference mark 42 etched on a collar portion 42*b* of the breech block member 30.

Figure 6:
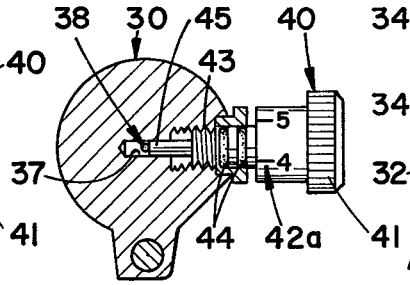

With reference to FIG. 6, the effective cross-sectional area of the high-temperature-resistant metering orifice 38 is determined by the position of an interfering gate portion 45 provided at the distal end of the knob portion 41, such gate portion being formed, for example, of tungsten carbide that can undergo and withstand the high temperatures (such as 5000° F.), of the combustion gases to which it is subjected. The gate portion 45 rides in and out of a transverse bore defined by a bore wall 37, such bore being perpendicular to the axis of the gun barrel member 12 (see FIG. 1) upon which the metering orifice 38 lies when the cylindrical breech block member 30 is at its firing position in alignment with the barrel member 12, as discussed earlier. A threaded portion 43 of the valve means 40, intermediate the knob portion 41 and gate portion 45, screws into and out of the breech block member 30, as illustrated in FIG. 6, the threaded portion 43 being adjacent to a pair of O-ring type elastomeric gas seals 44 which ensure that high pressure combustion gases forced through the metering orifice 38 do not leak out of the breech block member 30.

With further reference to FIGS. 5 and 6, rotation of the knob portion 41 causes the gate portion 45 of the valve means 40 to increase or decrease the effective area of the metering orifice 38, such degree of increase or decrease being indicated by the particular indicia 42*a* aligned with the reference mark 42. For a larger cross-sectional area, i.e., with the gate portion 45 moved to a rightward position as illustrated in FIG. 6, a high feed rate of combustion gas into the muzzle end 14 of the barrel member 12 will be effected wherein a high velocity and a long effective range of the dart would be provided (such as a No. 5 indicia setting as illustrated in FIG. 6). For a lower dart velocity and a decreased effective range, the knob portion 41 would be rotated (for example, to a No. 1 setting) to provide a reduced cross-sectional area of the orifice 38*a*, i.e., gate portion 45 moving to the right as viewed in FIG. 5. Thus, the feed rate of gases into the barrel 12 would be decreased. It is noted that inward movement of the gate portion is limited wherein the orifice 38 is never completely closed so as to avoid hazardous over-pressures in the breech block member 30 that could cause it to crack or burst.

Figure 7:
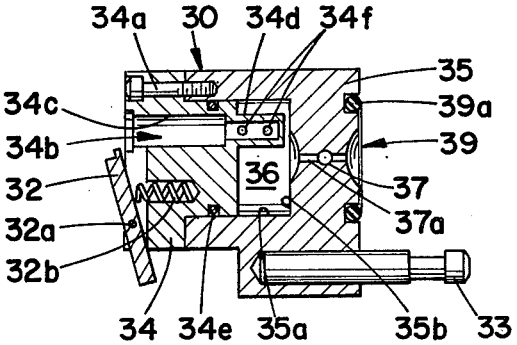
FIG. 7 is a longitudinal cross section view of the breech block member of FIG. 4.

With reference to FIG. 7, a blank cartridge receiving firing chamber 34*b* is defined by a bore wall 34*c* provided by the end cap portion 34. The end cap portion 34 also supports the ejector 32 biased by a spring 32*b* for pivotal movement about an axis defined by an ejector hinge pin 32*a*. The cylindrical end cap portion 34 includes at its reduced diameter forward end (the rightward end as viewed in FIG. 7) an elastomeric O-ring-type sealing member 34*e* to ensure fluid-tight relationship between the end cap 34 when it is inserted into the bore defined by walls 35*a*, 35*b* of the main body portion 35 of the breech block member 30. The blank cartridge receiving cylindrical firing chamber 34*b* defined by wall 34*c* has its inner end (rightward end as viewed in FIG. 7) closed by a baffle element 34*d*, which allows fluid communication from the firing chamber 34*b* to the swirl chamber 36 so as to provide high pressure combustion gas to the muzzle end 14 of the barrel member 12 via the gas discharge metering orifice 38.

In accordance with the present invention, the baffle element 34*d*, having one or more gas discharge apertures 34*f* transverse to the axis of the cylindrical chamber 34*b*, restricts the flow of combustion gases out of the chamber 34*b* into the chamber 36, such restriction ensuring the necessary high pressure and temperature to cause complete combustion of the smokeless-type gunpowder used in conventional blank cartridges. Further, the baffle element 34*d* causes a swirling action of the combustion gases in the chamber 36, this swirling action further ensuring complete combustion of the blank cartridge gunpowder.

The high pressure, high-temperature combustion gases present in the relatively small volume swirl chamber 36 are injected via a gas discharge bore 37*a* (defining a portion of the orifice 38) into the breech end 14 of the barrel to forcibly eject the dart 50 out the muzzle end thereof. To ensure that no leakage of the combustion gases occurs out of the interface area between the breech block member 30 and the sealing face 14*a* (see FIG. 3) of the breech end 14 of the barrel member 12, another elastomeric O-ring-type seal 39*a* circumferentially extends about a breech block gas discharge port area 39 to close the breech end 14 of the barrel. Due to the sealing effect of seals 34*e*, 39*a*, and 44 (see FIG. 6), all combustion gases generated by the exploded blank cartridge are injected into the breech end 14 of the barrel member 12. Thus, the ejection velocity and effective range of the dart are controlled solely by the position of the knob portion 41 which determines the cross-sectional area of the metering orifice 38 via which the combustion gases are channeled to the breech end 14 of the barrel member 12.

It is noted that the use of the valve means 40 is intended where blank cartridges of a fixed power value are utilized. In other applications, the valve 40 could be deleted or could remain at a fixed position where blank cartridges of different power value are utilized, since the pressures in the chambers **34*b*, 36** would then be varied, thus controlling the effective range of the dart.

It is also noted that while a rifle-type firearm has been illustrated and discussed with regard to FIGS. 1 through 7, it is contemplated that a pistol-type dart gun could also be utilized without departing from the scope of the invention. Further, other mechanisms, such as percussive type tools utilizing blank cartridges, may incorporate a breech block element as taught in accordance with the present invention.

In summary, the present invention as illustrated above provides a relatively simple and inexpensive hypodermic dart gun that can be quickly loaded for firing. Further, the simplicity of the breech block member 30 makes it easy to disassemble, thus facilitating cleaning. Finally, by ensuring complete burning of the blank cartridge gunpowder in relatively small volume, serially connected, high pressure combustion gas chambers **34*b* and 36, the present invention has successfully provided a hypodermic dart gun with consistent range accuracy after repeated firings with only occasional cleaning of the breach block member 30** being needed.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

I claim:

1. A hypodermic dart gun of the firearm type comprising:

an elongated barrel member having a breech end and a muzzle end, the breech end of the barrel member being adapted to receive and frictionally retain a hypodermic dart;

a pivotally mounted breech block member movable between a firing position, at which the breech block member engages and generally closes the breech end of the barrel, and a loading position, at which the breech block member disengages from said breech end to permit insertion of the hypodermic dart into said breech end, said movable breech block member having at least two serially connected chambers for directing combustion gases from an exploded blank cartridge into the breech end of the barrel to forcibly eject the dart out of the muzzle end thereof, the two chambers being in fluid communication with each other solely via baffle means restricting the flow of combustion gases from one chamber to the other to establish high combustion gas pressures and temperatures immediately subsequent to the exploding of the blank cartridge into one of the chambers, the other chamber providing combustion gases to said muzzle end of the barrel, said high combustion gas temperatures and pressures causing substantially complete burning of the combustion gases; and a firing mechanism for exploding the blank cartridge.

2. A hypodermic dart gun according to claim 1, wherein said pivotally mounted breech block member rotates about an axis parallel to the longitudinal axis of the barrel, the breech block member being cylindrically shaped with its longitudinal axis generally coinciding with the longitudinal axis of the barrel when the breech block member is at its firing position.

3. A hypodermic dart gun according to claim 1, including adjustable valve means mounted on the breech block member and interposed between the chambers and the breech end of the barrel, the valve means regulating the feed rate of the combusion gases from the chambers to the breech end of the barrel whereby the velocity of the ejected hypodermic dart, and hence its effective range, is dependent on the position of the valve means.

4. A hypodermic dart gun according to claim 3, wherein the valve means includes a high-temperature-resistant metering orifice whose cross-sectional area is adjusted to control the velocity of the hypodermic dart.

5. A hypodermic dart gun according to claim 1, including seal means mounted on the breech block member and engageable with the breech end of the barrel member to establish fluidtight engagement between the breech block member and the breech end of the barrel member when the breech block member is at its firing position, wherein no leakage of combustion gases occurs at the engagement interface area of the breech block member and the breech end of the barrel member.

6. A hypodermic dart gun of the firearm type comprising:

an elongated barrel member having a breech end and a muzzle end, the breech end of the barrel member being adapted to receive and frictionally retain a hypodermic dart;

a pivotally mounted breech block member movable between a firing position, at which the breech block member engages and generally closes the breech end of the barrel member, and a loading position, at which the breech block member disengages from said breech end to permit insertion of the hypodermic dart into said breech end, said breech block member having at least one chamber for directing high pressure combustion gases from an exploded blank cartridge into the breech end of the barrel member to forcibly eject the hypodermic dart out of the muzzle end thereof, the breech block member being adapted to receive and support said blank cartridge during firing;

a user-adjustable valve means interposed between the chamber and the breech end of the barrel, the valve means regulating the feed rate of the combustion gases from the chamber into the breech end of the barrel, the velocity of the ejected hypodermic dart, and hence its effective range, being dependent on the feed rate, the valve means, the chamber, and the blank cartridge being generally aligned with the elongated barrel member when the breech block member is at its firing position; and a firing mechanism for exploding the blank cartridge.

7. A hypodermic dart gun according to claim 6, wherein the valve means includes a high-temperature-resistant metering orifice whose cross-sectional area can be adjusted by the gun user to vary the velocity of the ejected hypodermic dart and hence vary its effective range.

8. A hypodermic dart gun according to claims 1 or 6, wherein substantially all of the said combustion gases generated by the exploded blank cartridge are directed into the breech end of the barrel.

* * * * *